US008405569B2

(12) United States Patent
Tran et al.

(10) Patent No.: US 8,405,569 B2
(45) Date of Patent: Mar. 26, 2013

(54) ANTENNA CONFIGURATION

(75) Inventors: Michael Tran, Mississauga (CA); Laurian Petru Chirila, Irvine, CA (US); Richard Biasutto, Milton (CA)

(73) Assignee: Psion Inc., Mississauga, Ontario (CA)

( * ) Notice: Subject to any disclaimer, the term of this patent is extended or adjusted under 35 U.S.C. 154(b) by 293 days.

(21) Appl. No.: 12/965,447

(22) Filed: Dec. 10, 2010

(65) Prior Publication Data

US 2012/0146877 A1 Jun. 14, 2012

(51) Int. Cl.
*H01Q 21/00* (2006.01)

(52) U.S. Cl. ..... 343/879; 343/702

(58) Field of Classification Search ..... 343/702, 343/879

See application file for complete search history.

(56) References Cited

U.S. PATENT DOCUMENTS

| | | | | |
|---|---|---|---|---|
| 6,222,502 | B1 * | 4/2001 | Falbo et al. | 343/879 |
| 6,606,075 | B1 * | 8/2003 | Chun | 343/890 |
| 7,050,009 | B2 * | 5/2006 | Chirila | 343/702 |

* cited by examiner

*Primary Examiner* — Tan Ho

(57) ABSTRACT

A bracket assembly is provided for attaching to a mobile computing device. The mobile computing device has a use range at which the mobile device is typically positioned when in use. The use range varies between a low end angle and a high end angle. The mobile computing device also has a housing having a reference plane. The bracket assembly is configured to support a first antenna at a first angle and a second antenna at a second angle, each of the first angle and the second angle being measured with respect to the reference surface when the bracket assembly is attached to the mobile computing device. The first angle is selected so that the first antenna is in a vertical plane when the mobile computing device is positioned at the low end angle. The second angle is selected so that the second antenna is in a vertical plane when the mobile computing device is positioned at the high end angle.

18 Claims, 6 Drawing Sheets

ANTENNA CONFIGURATION

The present invention relates generally to an antenna assembly and specifically to an antenna assembly that provides vertical antenna polarization for use with a mobile computing device or the like.

BACKGROUND OF THE INVENTION

Polarization of an antenna refers to the orientation of an electric field of its radio wave with respect to the earth's surface and is determined by the physical structure of the antenna and by its orientation. Thus, a simple straight wire antenna will have one polarization when mounted vertically, and a different polarization when mounted horizontally.

Polarization is largely predictable from antenna construction. For radio antennas, polarization corresponds to the orientation of the radiating element in an antenna. For a linearly polarized antenna, a vertically positioned antenna will result in vertical polarization. Similarly a horizontally positioned antenna will result in horizontal polarization.

In practice, it is preferable that the orientation of linearly polarized antennas on a transmitter are matched with the orientation of the linearly polarized antennas on a receiver, or else the strength of a signal received at the receiver will be reduced. That is, vertically polarized antennas on a transmitting device are preferably used with vertically polarized antennas on a receiving device and horizontally polarized antennas on a transmitting device are preferably used with horizontally polarized antennas on a receiving device. Intermediate matchings between transmitter antenna and receiver antenna will result in a loss of some received signal strength, but not as much as would result in the case of a complete mismatch between antenna polarizations.

The most common and cost effective method for providing circular coverage area around a base-station antenna is to install an omni-directional antenna pointed upward, perpendicular to the earth. This forces vertical polarization and provides a pattern that is omni-directional in azimuth. Such an antenna position is used in many radio communication schemes such as wireless phone networks, mobile ultra high frequency (UHF) radio such as Citizen's Band (CB) radio, Wi-Fi™ and the like. If the same antenna is mounted parallel to the earth then it will yield horizontal polarization. As a result, the pattern is no longer omni-directional but a "figure 8". That is, for example, if the tip of the antenna is at 0°, then you will have maximum radiation 90° and 270°, but little radiation at 0° and 180° deg. If there is a need to provide omni-directional coverage with horizontal polarization then the most common method is to use three sector antennas, each designed for horizontal polarization. As a result, it is more expensive and complex to implement an omni-directional horizontally polarized antenna because there are three antennas, a three-way splitter, and three more cables.

Thus, many radio transceivers such as base-stations, for example, are configured with vertically polarized antennas. Accordingly, it is preferable to provide vertically polarized antennas in the transmitting devices in communication with the base-stations. However, due to size limitations, antennas in some mobile communication devices are configured in a horizontal position and, thus, are horizontally polarized. This mismatch results in a loss of signal strength between the mobile communication device and the base-station.

In order to overcome this problem, base-stations or the like can be configured to have horizontally polarized antennas in order to match the horizontally polarized antennas in the mobile communication devices. Such a solution is easiest to implement when designing a network infrastructure from scratch. However, if the mobile communication device is to be used in an existing infrastructure, it is a deterrent to suggest that the existing network infrastructure be overhauled in order to use the mobile communication device efficiently. Further, it is likely that the mobile communication device will be used along with a plurality of different devices, potentially having differently polarized antennas, exacerbating the problem. Yet further, as described above, it is more expensive to provide a base-station having an omni-directional antenna that is horizontally polarized.

Therefore it is an object of the present invention to obviate or mitigate at least one of the above mentioned disadvantages.

SUMMARY

In accordance with an aspect of the present invention there is provided a bracket assembly for attaching to a mobile computing device, the mobile computing device having a use range at which the mobile device is typically positioned when in use, the use range being between a low end angle and a high end angle, the mobile computing device comprising a housing having a reference plane, the bracket assembly configured to support a first antenna at a first angle and a second antenna at a second angle, each of the first angle and the second angle being measured with respect to the reference surface when the bracket assembly is attached to the mobile computing device, the first angle being selected so that the first antenna is in a vertical plane when the mobile computing device is positioned at the low end angle, the second angle being selected so that the second antenna is in a vertical plane when the mobile computing device is positioned at the high end angle.

In accordance with a further aspect of the present invention there is provided a mobile computing device having a use range at which the mobile device is typically positioned when in use, the use range being between a low end angle and a high end angle, the mobile computing device comprising: a housing having a reference plane; a computing assembly located within the housing; a radio transceiver configured to transfer data between the computing assembly and a remote transceiver; an antenna assembly operably connected to the radio transceiver to propagate signals from the radio transceiver to the remote transceiver and to apply signals received from the remote transceiver to the radio transceiver, the antenna assembly comprising: at least a first antenna and a second antenna; and a bracket assembly configured to support the first antenna at a first angle and the second antenna at a second angle, each of the first angle and the second angle being measured with respect to the display surface of the display screen, the first angle being selected so that the first antenna is in a vertical plane when the mobile computing device is positioned at the low end angle, the second angle, being selected so that the second antenna is in a vertical plane when the mobile computing device is positioned at the high end angle.

BRIEF DESCRIPTION OF THE DRAWINGS

Embodiments of the present invention will now be described by way of example only with reference to the following drawings in which.

DETAILED DESCRIPTION OF THE PREFERRED EMBODIMENTS

Figure 1:
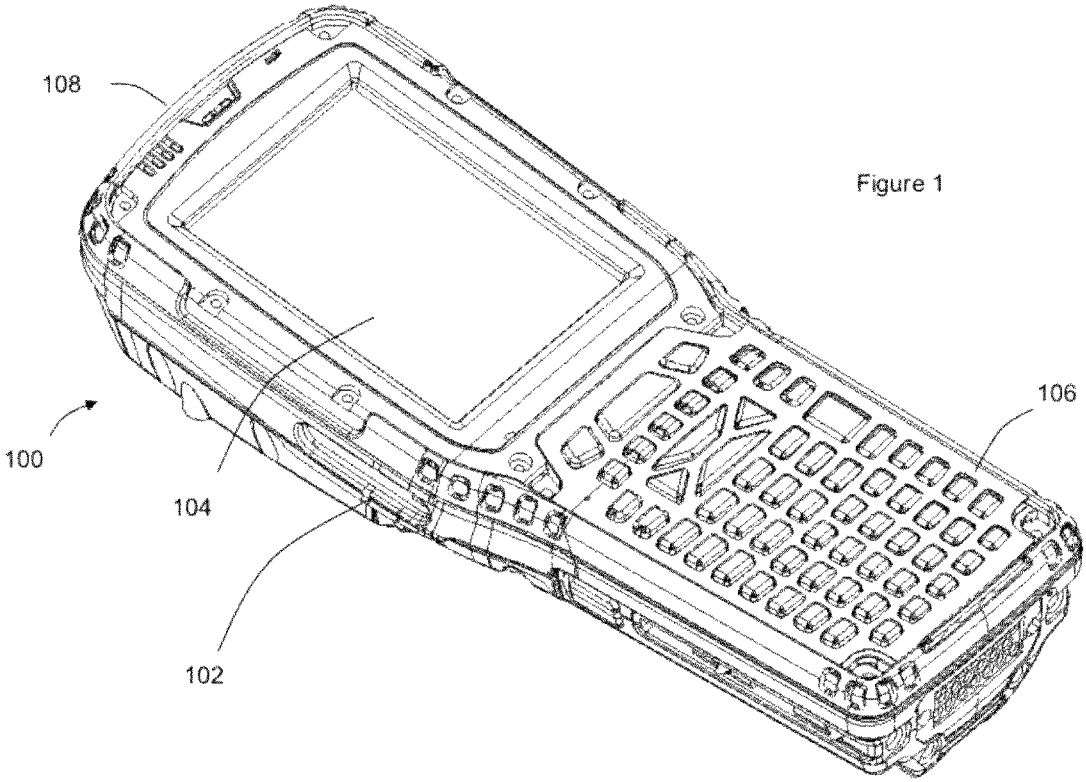
FIG. 1 is a perspective view of a mobile computing device with antennas configured in accordance with an embodiment.

For convenience, like numerals in the description refer to like structures in the drawings. Referring to FIG. 1, a mobile computing device is illustrated generally by numeral 100. Mobile computing device 100 comprises a main body 102, a screen 104, a keypad 106 and an endcap 108. In the present embodiment, mobile computing device 100 is constructed to be modular and readily configurable to accommodate different modules. For example, an antenna, or antennas, can be placed beneath endcap 108. This modularity allows antennas to be easily removed, added or replaced.

Figure 2:
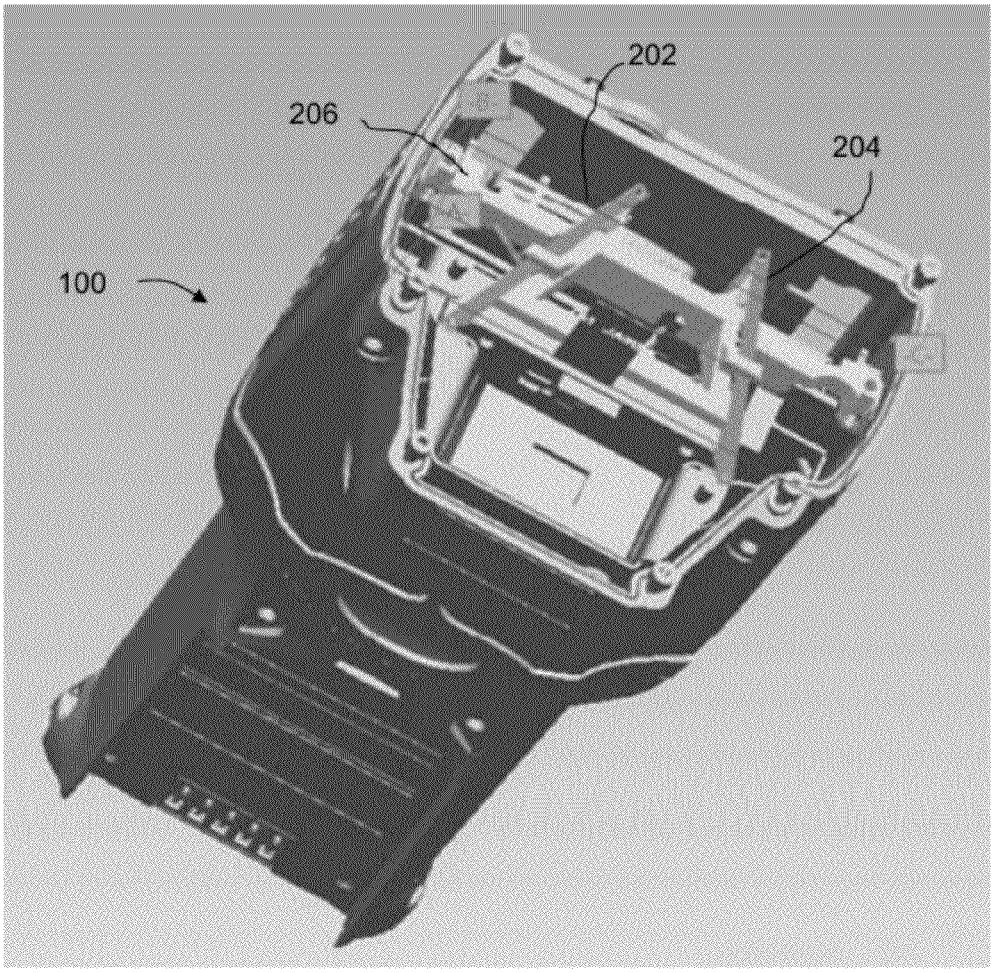
FIG. 2 is a perspective view of the mobile computing device without an endcap, illustrating the antennas.

Referring to FIG. 2, mobile computing device 100 without endcap 108 is illustrated. In the present embodiment, mobile computing device 100 further comprises a first antenna 202, a second antenna 204 and a bracket assembly 206. In the present embodiment, first antenna 202 and second antenna 204 comprise an antenna as described in U.S. Pat. No. 7,050,009, titled "Internal Antenna", issued to Laurian P. Chirila. First antenna 202 and second antenna 204 are attached to main body 102 via bracket assembly 206. First antenna 202 and second antenna 204 are electrically connected to a radio transceiver (not shown) for processing signals received or to be transmitted via first antenna 202 or second antenna 204. In the present embodiment, the radio transceiver is configured to operate using antenna diversity to select one of first antenna 202 or second antenna 204 depending on a number of different factors, including signal strength. The design, selection and operation of such antenna diversity schemes will be readily apparent to those of skill in the art and will not be described further herein.

As illustrated in FIG. 2, first antenna 202 and second antenna 204 are positioned at an angle to mobile computing device 100 and are not necessarily parallel to each other, as will be described in greater detail with reference to FIGS. 3*a*, 3*b* and 3*c*.

Figure 3A:
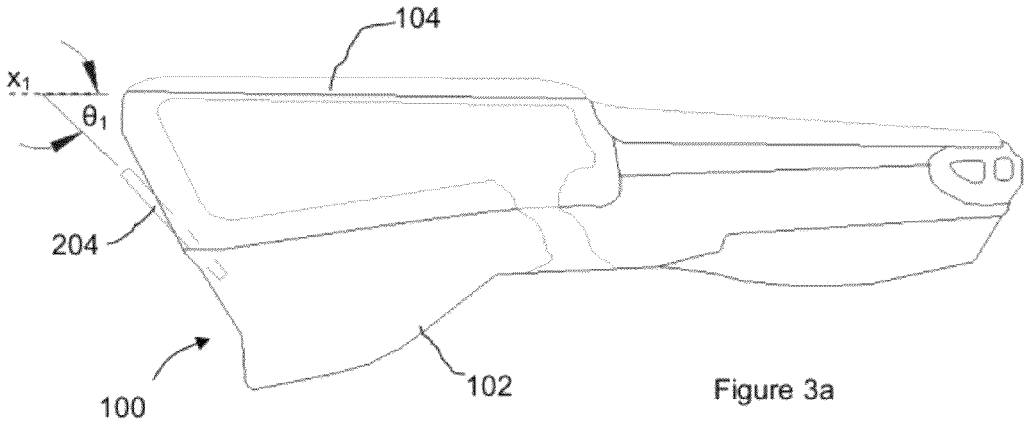
FIG. 3*a* is a side view of the mobile computing device.

Referring to FIG. 3*a*, a side view of mobile computing device 100 without endcap 108 is illustrated. A first axis $X_1$ extends in a plane defined by screen 104. In the present embodiment, both first antenna 202 and second antenna 204 are positioned at an inclination angle $\theta_1$ to first axis $X_1$. Further, in the present embodiment, screen 104 is substantially coplanar, or parallel, with an upper surface of main body 102.

Figure 3B:
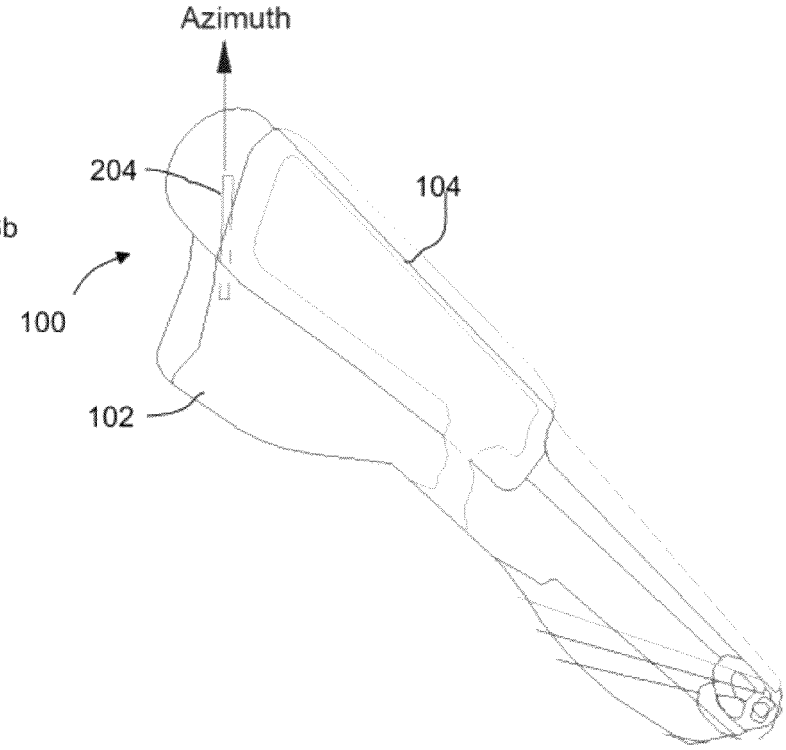
FIG. 3*b* is a side view of the mobile computing device at a typical use angle.

Referring to FIG. 3*b*, a side view of mobile computing device 100 with endcap 108 is illustrated. As shown in FIG. 3*b*, mobile computing device 100 is in a typical use position.

In order to match polarization of first antenna 202 and second antenna 204 as much as possible with vertically polarized base-station antennas, it is desirable that first antenna 202 and second antenna 204 be substantially vertical when mobile computing device 100 is in use. Thus, inclination angle $\theta_1$ is selected so that when mobile computing device 100 is in a position in which it is anticipated to be used, referred to as the use position, first antenna 202 and second antenna 204 will be aligned in a vertical plane. The use position can be estimated through one or more of experimentation, field trials or ergonomic study.

Figure 3C:
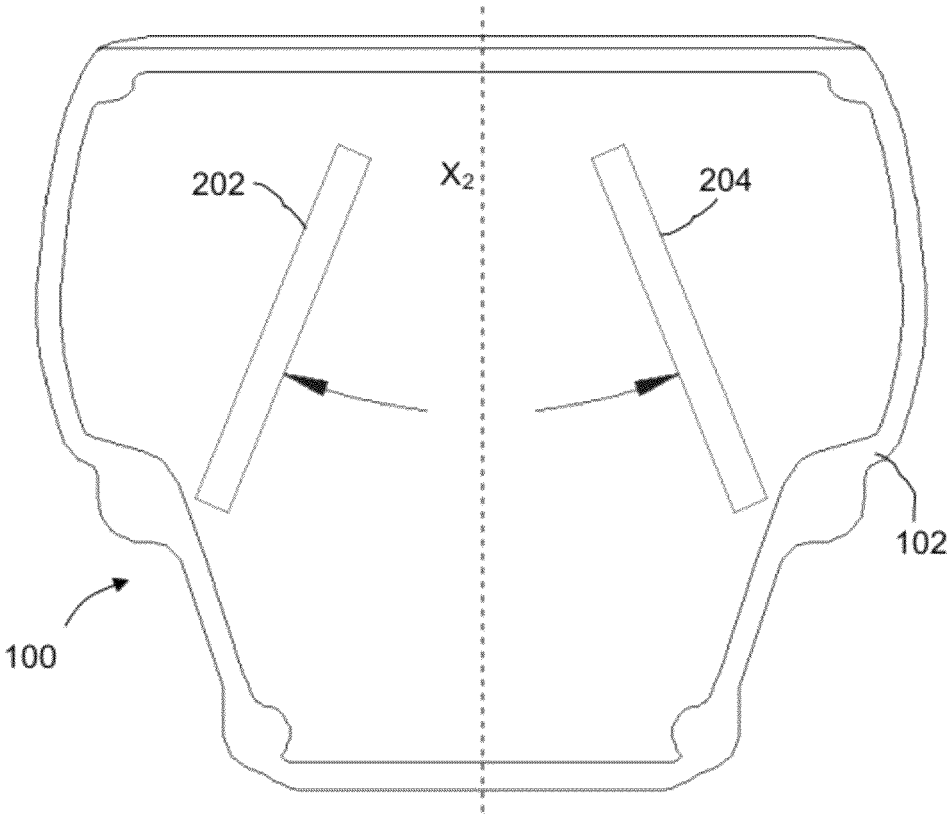
FIG. 3*c* is a front view of the mobile computing device.

Referring to FIG. 3*c*, a front view of mobile computing device 100 without endcap 108 is illustrated. As illustrated, first antenna 202 and second antenna 204 are not positioned parallel to each other. Therefore, when the mobile compute device 100 is in the use position, first antenna 202 and second antenna 204 include both a vertically polarized component and a horizontally polarized component. Further, in the present embodiment, first antenna 202 and second antenna 204 are symmetric about symmetry axis $X_2$.

As will be appreciated by a person of ordinary skill in the art, positioning first antenna 202 and second antenna 204 as described provides a number of advantages. For example, first antenna 202 and second antenna 204 will be positioned in a substantially vertical plane during use. Although it is difficult to predict an exact use position, positioning first antenna 202 and second antenna 204 based on the anticipated use position increases the likelihood of first antenna 202 and second antenna 204 being in a vertical plane, or substantially vertical plane, when mobile computing device 100 is in use.

As another example, often times mobile computing device 100 has space restrictions, especially at endcap 108. Accordingly, positioning first antenna 202 and second antenna 204 so they are not parallel can help position them within endcap 108 by reducing the overall height required for the first antenna 202 and second antenna 204.

As another example, although a majority of base-station antennas are configured for vertical polarization, some network infrastructures may include one or more base-station antennas configured for horizontal polarization. Accordingly, positioning first antenna 202 and second antenna 204 so they are not parallel provides some amount of horizontal polarization. Such horizontal polarization will likely improve the signal strength between mobile computing device 100 and base-stations having antennas that are horizontally polarized.

As another example, whenever an electromagnetic wave is reflected off a metallic surface, its polarization will shift. In an open environment, the polarization of the signal received at mobile computing device 100 will be similar to the polarization of the base-station antenna. However in a dense environment, such as a warehouse for example, multipath propagation of a signal transmitted from the base-station is present and the polarization of the signal received at mobile computing device 100 may include both vertically polarized and horizontally polarized vectors. Having first antenna 202 and second antenna 204 positioned inside the terminal to include some horizontal polarization allows mobile computing device 100 to work at a reasonable performance under these conditions.

Figure 4:
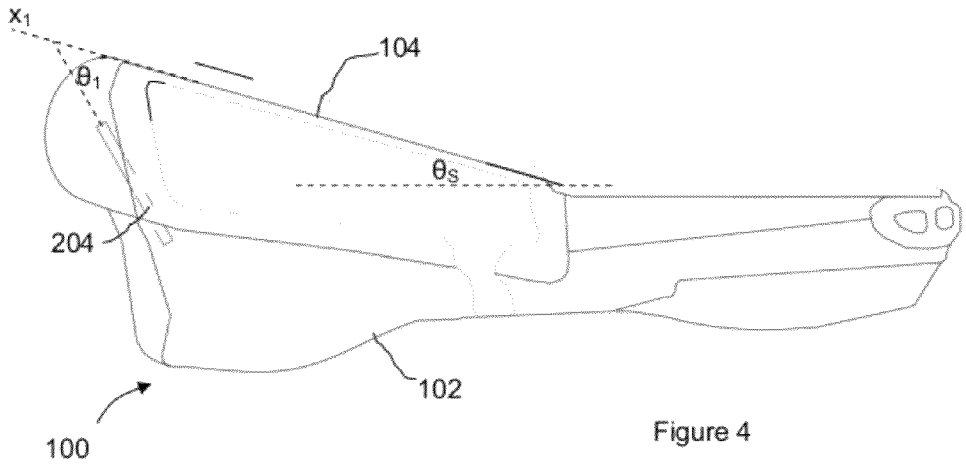
FIG. 4 is a side view of an alternate embodiment of the mobile computing device.

In the embodiment described above, screen 104 is substantially coplanar with or parallel to main body 102. Referring to FIG. 4, an alternate embodiment of mobile computing device 100 is shown. In the present embodiment, screen 104 is configured at a screen angle $\theta_S$ to main body 102.

Similar to the previous embodiment, it is desirable that first antenna 202 and second antenna 204 are in a substantially vertical plane when mobile computing device 100 is in use. Thus, screen angle $\theta_S$ may also need to be considered when determining inclination angle $\theta_1$.

Accordingly, when an operator uses mobile computing device 100, first antenna 202 and second antenna 204 will be in a substantially vertical plane, thereby providing substantially vertical polarization.

As will be appreciated by a person of ordinary skill in the art, the proximity of first antenna 202 and second antenna 204 to the vertical plane largely depends on the precision of the estimation of the use position. However, even if the use position is not precisely estimated, the position of first antenna 202 and second antenna 204 is still improved when compared with the prior art, thereby improving the signal strength for communication with the base-stations.

Figure 5:
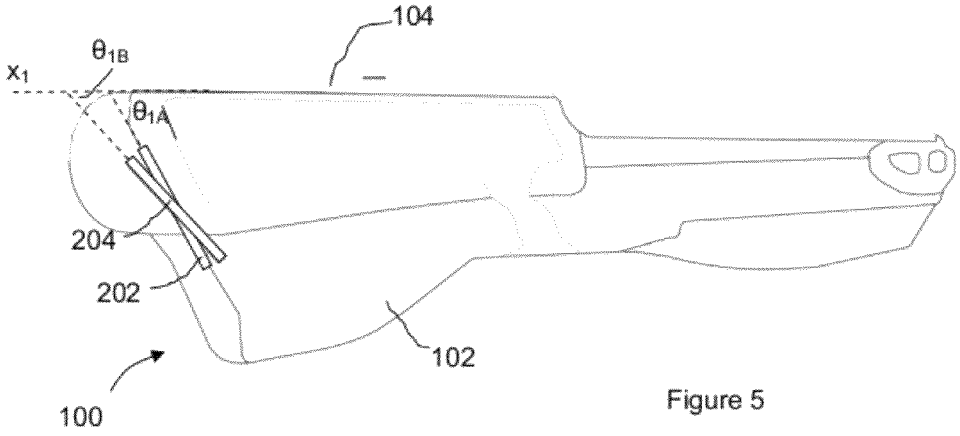
FIG. 5 is a side view of yet an alternate embodiment of the mobile computing device.

Referring to FIG. 5, an alternate embodiment of mobile computing device is illustrated. In this embodiment, first antenna 202 and second antenna 204 are configured at different angles to first axis $X_1$. In the previous embodiments, both first antenna 202 and second antenna 204 are configured at inclination angle $\theta_1$. However in the present embodiment, first antenna 202 is configured at a first inclination angle $\theta_{1A}$ and second antenna 204 is configured at a second inclination angle $\theta_{1B}$. It will be appreciated that where $\theta_{1A}=\theta_{1B}$, the antenna configuration is the same as the previously described embodiments. However, where $\theta_{1A}\neq\theta_{1B}$ first antenna 202 and second antenna 204 can be configured to provide a use range of varying use positions for mobile computing device 100. The use range spans from a predetermined low end angle to a predetermined high end angle. That is, for example, if it is determined that use position may range from a low end angle of 40° to high end use angle of 50°, first inclination angle $\theta_{1A}$ is selected to be 90°−40°=50° and second inclination angle $\theta_{1B}$ is selected to be 90°−50°=40°. Therefore, the potential variation in use position is accounted for by the variation in configuration between first antenna 202 and second antenna 204. As mentioned above, depending upon the position of device 100, one of first antenna 202 and second antenna 204 is selected for use by a suitable antenna diversity scheme, as is known in the art.

In the embodiments described above, first antenna 202 and second antenna 204 are connected to main body 102 via bracket assembly 206. In an alternate embodiment, bracket assembly 206 is rotatably connected to main body 102, thereby permitting in-field modification to the positioning of first antenna 202 and second antenna 204 within mobile computing device 100. Once bracket assembly 206 is rotated into a desired position, it is fixed in that position using a set screw or other known mechanism.

In yet another alternate embodiment, first antenna 202 and second antenna 204 are attached to bracket assembly 206 via a flexible material, thereby permitting in-field modification to the configuration of first antenna 202 and second antenna 204. The flexible material is sufficiently pliable to allow intentional modification of first inclination angle $\theta_{1A}$ and second inclination angle $\theta_{1B}$, yet is also sufficiently resilient so as to resist accidental modification thereof. The flexible material may be a plastic or other material, but care must be taken not to inhibit the performance of either first antenna 202 or second antenna 204.

Bracket assembly 106 described above may comprise a single bracket for both first antenna 202 and second antenna 204 or a separate bracket for each of first antenna 202 and second antenna 204.

Further, although previous embodiments describe first antenna 202 and second antenna 204 as being symmetric about symmetry axis $X_2$, this need not be true for all implementations.

Figure 6:
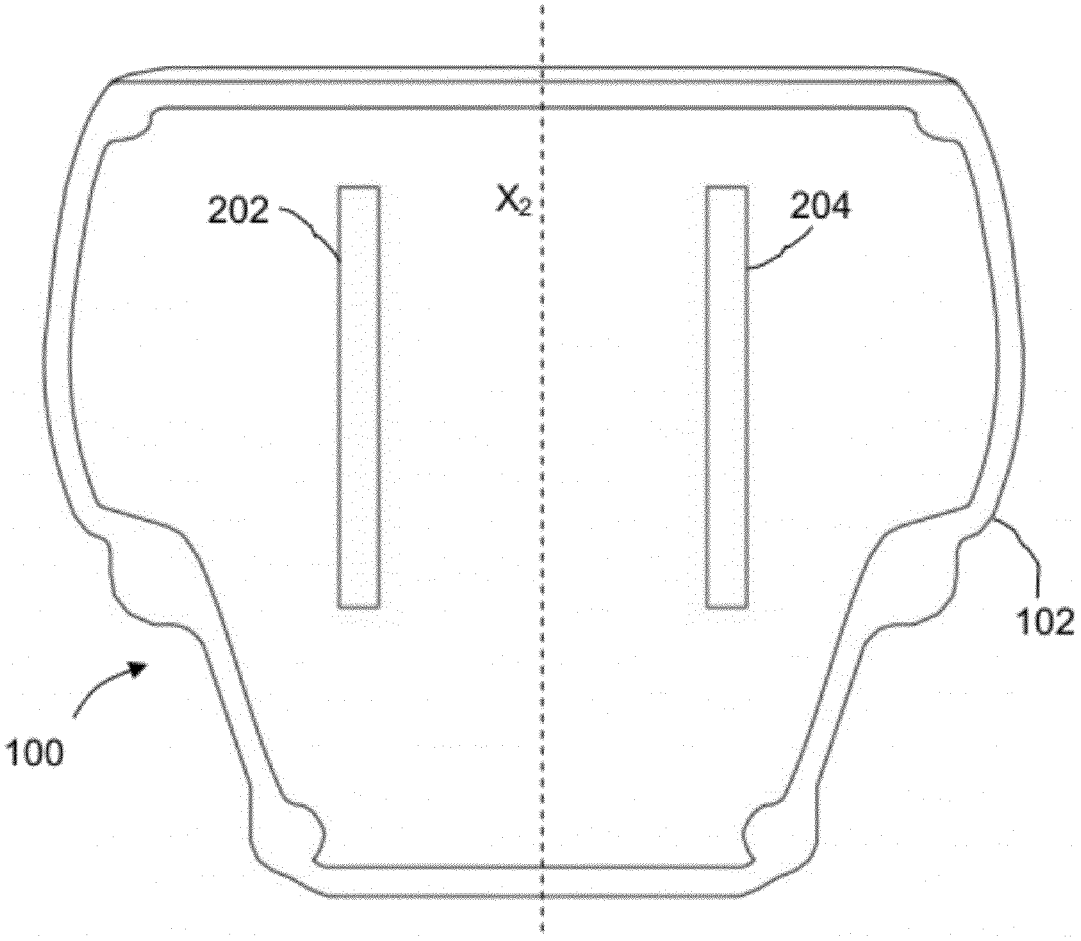
FIG. 6 is a front view of yet an alternate embodiment of the mobile computing device.
Figure 4:
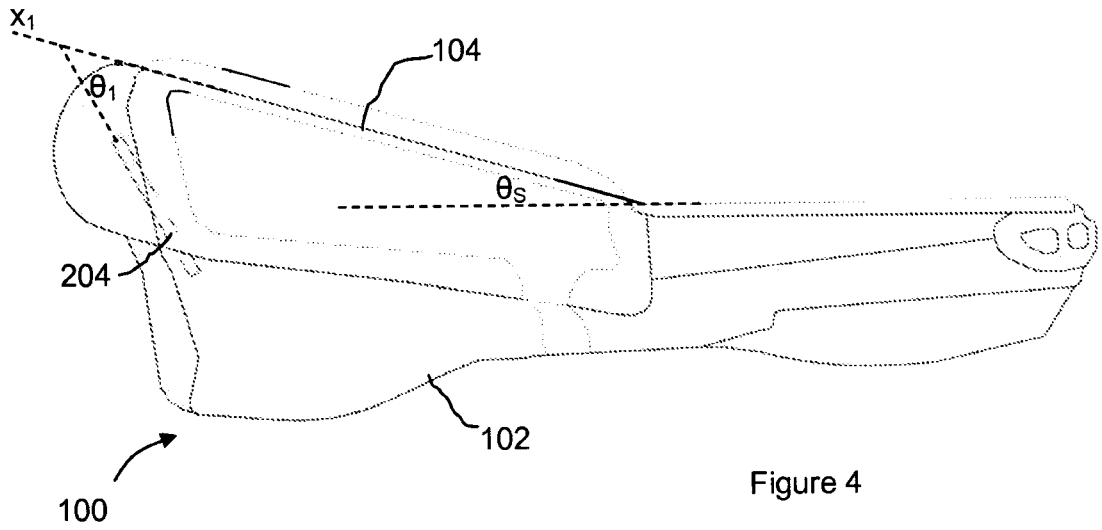
Figure 5:
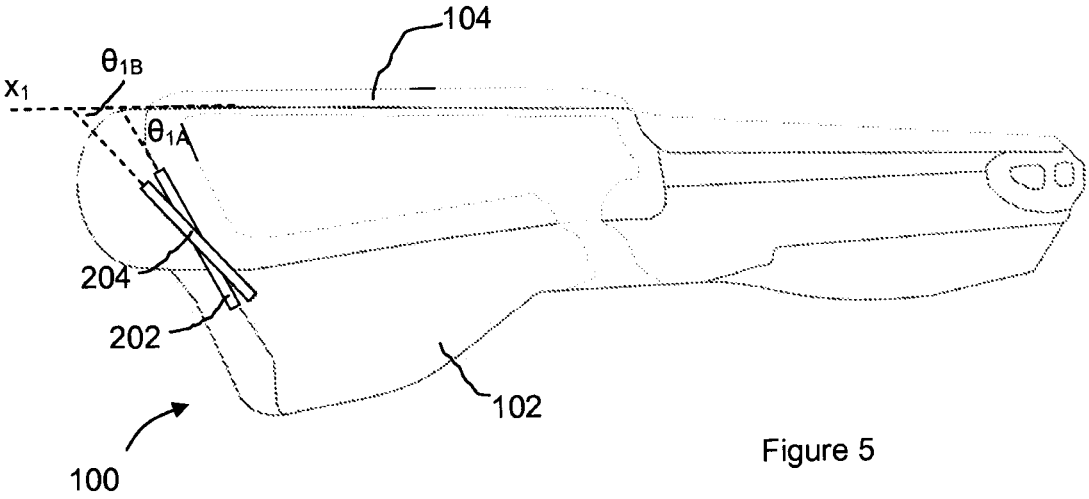

Referring to FIG. 6, in an alternate embodiment, first antenna 202 and second antenna 204 are positioned so that first antenna 202 and second antenna 204 are parallel and $\theta_{1A}=\theta_{1B}$. As will be appreciated, in the present embodiment there will likely be little to no horizontal polarization of first antenna 202 and second antenna 204 based on their positioning within mobile computing device 100. However, both first antenna 202 and second antenna 204 will be substantially vertical during use of mobile computing device, thereby providing greater vertical polarization. Thus, for example, the present embodiment may be preferable in an open environment comprising a plurality of base-stations having vertically polarized antennas.

Yet further, although the previous embodiment have been described with $\theta_1$, $\theta_{1A}$, and $\theta_{1B}$ all being taken with reference the plane of screen 104, it will be appreciated that this plane is one merely of choice and another reference plane, such as a plane of keypad 106, for example, could also be used Yet further, although the term mobile computing device is used herein with regard to a particular embodiment, it will be appreciated by a person of ordinary skill in the art that the term mobile computing device includes other implementations such as handheld computers, smart phones, personal digital assistants and the like.

In summary, it will be appreciated that the present invention provides an antenna configuration that results in an improved vertical polarization of the antenna when mobile computing device 100 is in use.

Although preferred embodiments of the invention have been described herein, it will be understood by those skilled in the art that variations and combinations may be made thereto without departing from the scope of the appended claims.

What is claimed is:

1. An antenna assembly for attaching to a mobile computing device, the mobile computing device having a use range at which the mobile device is typically positioned when in use, the use range being between a low end angle and a high end angle, the mobile computing device comprising a housing having a reference plane and a radio transceiver to propagate signals from the radio transceiver to the remote transceiver and to apply signals received from the remote transceiver to the radio transceiver, the antenna assembly comprising:

at least a first antenna and a second antenna; and a bracket assembly configured to support the first antenna at a first inclination angle and the second antenna at a second inclination angle, each of the first inclination angle and the second inclination angle being measured with respect to the reference surface when the bracket assembly is attached to the mobile computing device, the first inclination angle being selected so that the first antenna is in a vertical plane when the mobile computing device is positioned at the low end angle, the second inclination angle being selected so that the second antenna is in a vertical plane when the mobile computing device is positioned at the high end angle.

2. The antenna assembly of claim 1, wherein the low end angle and the high end angle are the same and the first inclination angle and the second inclination angle are the same.

3. The antenna assembly of claim 1, wherein the bracket assembly is configured to be rotatably attached to the mobile computing device so that the first inclination angle and the second inclination angle can be modified, the bracket assembly further comprising a securing mechanism to inhibit rotation of the bracket assembly when the mobile computing device is in use.

4. The antenna assembly of claim 1 further comprising a flexible material for attaching to the first antenna and the second antenna so that the first inclination angle and the second inclination angle can be modified.

5. The antenna assembly of claim 1, wherein the first antenna and the second antenna are positioned parallel to each other.

6. The antenna assembly of claim 1, wherein the first antenna and the second antenna are symmetric about a symmetry axis.

7. The antenna assembly of claim 1, wherein the reference plane is a plane defined by at least one of a screen or a keypad of the mobile computing device.

8. The antenna assembly of claim 7, wherein the screen is positioned at a screen angle to the housing.

9. The antenna assembly of claim 1, where in the bracket assembly comprises a separate bracket for each of the first antenna and the second antenna.

10. A mobile computing device having a use range at which the mobile device is typically positioned when in use, the use range being between a low end angle and a high end angle, the mobile computing device comprising:

a housing having a reference plane;

a computing assembly located within the housing;

a radio transceiver configured to transfer data between the computing assembly and a remote transceiver;

an antenna assembly operably connected to the radio transceiver to propagate signals from the radio transceiver to the remote transceiver and to apply signals received from the remote transceiver to the radio transceiver, the antenna assembly comprising:

at least a first antenna and a second antenna; and a bracket assembly configured to support the first antenna at a first angle and the second antenna at a second angle, each of the first angle and the second angle being measured with respect to the display surface of the display screen, the first angle being selected so that the first antenna is in a vertical plane when the mobile computing device is positioned at the low end angle, the second angle, being selected so that the second antenna is in a vertical plane when the mobile computing device is positioned at the high end angle.

11. The mobile computing device of claim 10, wherein the low end angle and the high end angle are the same and the first inclination angle and the second inclination angle are the same.

12. The mobile computing device of claim 10, wherein the bracket assembly is configured to be rotatably attached to the mobile computing device so that the first inclination angle and the second inclination angle can be modified, the bracket assembly further comprising a securing mechanism to inhibit rotation of the bracket assembly when the mobile computing device is in use.

13. The mobile computing device of claim 10 further comprising a flexible material for attaching to the first antenna and the second antenna so that the first inclination angle and the second inclination angle can be modified.

14. The mobile computing device of claim 10, wherein the first antenna and the second antenna are positioned parallel to each other.

15. The mobile computing device of claim 10, wherein the first antenna and the second antenna are symmetric about a symmetry axis.

16. The mobile computing device of claim 10, wherein the reference plane is a plane defined by at least one of a screen or a keypad of the mobile computing device.

17. The mobile computing device of claim 16, wherein the screen is positioned at a screen angle to the housing.

18. The mobile computing device of claim 10, where in the bracket assembly comprises a separate bracket for each of the first antenna and the second antenna.

* * * * *

UNITED STATES PATENT AND TRADEMARK OFFICE

CERTIFICATE OF CORRECTION

PATENT NO. : 8,405,569 B2
APPLICATION NO. : 12/965447
DATED : March 26, 2013
INVENTOR(S) : Trn et al.

It is certified that error appears in the above-identified patent and that said Letters Patent is hereby corrected as shown below:

Delete Title page, and replace with new Title page. (attached)

Drawings

Delete Drawing sheet 5, and replace with new drawing sheet 5. (attached)

Signed and Sealed this
Fourth Day of February, 2014

Michelle K. Lee

Michelle K. Lee
*Deputy Director of the United States Patent and Trademark Office*

(12) United States Patent
Tran et al.

(10) Patent No.: US 8,405,569 B2
(45) Date of Patent: Mar. 26, 2013

(54) ANTENNA CONFIGURATION

(75) Inventors: Michael Tran, Mississauga (CA); Laurian Petru Chirila, Irvine, CA (US); Richard Biasutto, Milton (CA)

(73) Assignee: Psion Inc., Mississauga, Ontario (CA)

( * ) Notice: Subject to any disclaimer, the term of this patent is extended or adjusted under 35 U.S.C. 154(b) by 293 days.

(21) Appl. No.: 12/965,447

(22) Filed: Dec. 10, 2010

(65) Prior Publication Data

US 2012/0146877 A1 Jun. 14, 2012

(51) Int. Cl.
*H01Q 21/00* (2006.01)

(52) U.S. Cl. ..... 343/879; 343/702

(58) Field of Classification Search ..... 343/702, 343/879

See application file for complete search history.

(56) References Cited

U.S. PATENT DOCUMENTS

| | | | | |
|---|---|---|---|---|
| 6,222,502 | B1 * | 4/2001 | Falbo et al. | 343/879 |
| 6,606,075 | B1 * | 8/2003 | Chun | 343/890 |
| 7,050,009 | B2 * | 5/2006 | Chirila | 343/702 |

* cited by examiner

*Primary Examiner* — Tan Ho

(57) ABSTRACT

A bracket assembly is provided for attaching to a mobile computing device. The mobile computing device has a use range at which the mobile device is typically positioned when in use. The use range varies between a low end angle and a high end angle. The mobile computing device also has a housing having a reference plane. The bracket assembly is configured to support a first antenna at a first angle and a second antenna at a second angle, each of the first angle and the second angle being measured with respect to the reference surface when the bracket assembly is attached to the mobile computing device. The first angle is selected so that the first antenna is in a vertical plane when the mobile computing device is positioned at the low end angle. The second angle is selected so that the second antenna is in a vertical plane when the mobile computing device is positioned at the high end angle.

18 Claims, 6 Drawing Sheets

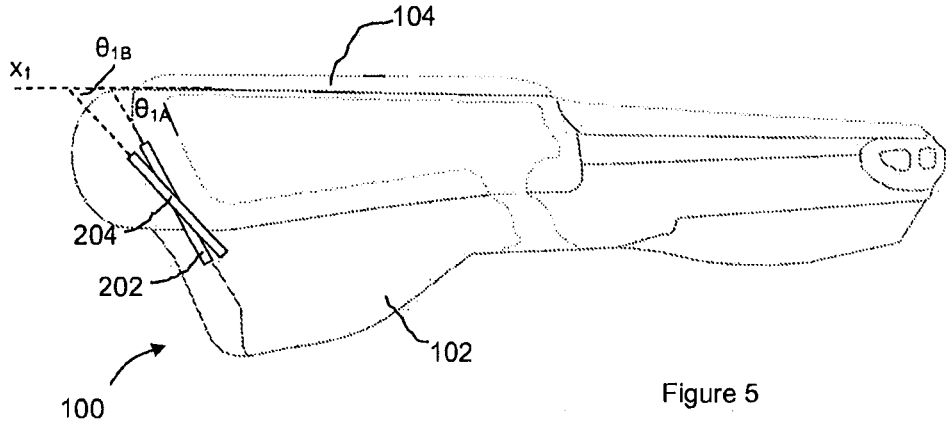

Figure 5